US009470374B2

(12) United States Patent
Chen

(10) Patent No.: US 9,470,374 B2
(45) Date of Patent: Oct. 18, 2016

(54) OMNIDIRECTIONAL LED LAMP

(71) Applicant: Hung-Chang Chen, Taipei (TW)

(72) Inventor: Hung-Chang Chen, Taipei (TW)

( * ) Notice: Subject to any disclaimer, the term of this patent is extended or adjusted under 35 U.S.C. 154(b) by 236 days.

(21) Appl. No.: 14/510,111

(22) Filed: Oct. 9, 2014

(65) Prior Publication Data

US 2016/0102812 A1 Apr. 14, 2016

(51) Int. Cl.

| | |
|---|---|
| ***F21K 9/232*** | (2016.01) |
| ***F21K 99/00*** | (2016.01) |
| ***F21V 25/04*** | (2006.01) |
| *F21V 23/04* | (2006.01) |
| *F21Y 111/00* | (2016.01) |
| *F21Y 101/02* | (2006.01) |
| *F21Y 103/00* | (2016.01) |

(52) U.S. Cl.

CPC ..... *F21K 9/1355* (2013.01); *F21K 9/13* (2013.01); *F21V 25/04* (2013.01); *F21V 23/0492* (2013.01); *F21Y 2101/02* (2013.01); *F21Y 2103/003* (2013.01); *F21Y 2111/002* (2013.01)

(58) Field of Classification Search

CPC ..... F21Y 2111/001; F21Y 2111/002; F21V 25/04; F21K 9/135; F21K 9/1355

See application file for complete search history.

(56) References Cited

U.S. PATENT DOCUMENTS

| | | | | |
|---|---|---|---|---|
| 9,239,160 | B1 * | 1/2016 | Wang | F21V 29/83 |
| 2004/0114367 | A1 * | 6/2004 | Li | F21K 9/135 362/248 |
| 2005/0207152 | A1 * | 9/2005 | Maxik | F21K 9/135 362/231 |
| 2008/0093998 | A1 * | 4/2008 | Dennery | F21K 9/13 315/246 |
| 2009/0161381 | A1 * | 6/2009 | Wu | F21K 9/135 362/545 |
| 2010/0027261 | A1 * | 2/2010 | Yashima | C09J 7/0282 362/249.02 |
| 2011/0156584 | A1 * | 6/2011 | Kim | F21K 9/00 315/32 |
| 2011/0204393 | A1 * | 8/2011 | Masumoto | F21V 3/00 257/88 |
| 2012/0194071 | A1 * | 8/2012 | Huang | F21K 9/13 315/35 |
| 2014/0362573 | A1 * | 12/2014 | Imai | H01L 33/60 362/247 |
| 2015/0036341 | A1 * | 2/2015 | Ge | F21K 9/13 362/240 |
| 2015/0043203 | A1 * | 2/2015 | Bengtsson | F21V 29/004 362/218 |
| 2015/0098223 | A1 * | 4/2015 | Su | F21K 9/135 362/249.02 |

* cited by examiner

*Primary Examiner* — Charlie Y Peng

(57) ABSTRACT

An omnidirectional LED lamp contains a holder. The holder includes an electrical connecting member couple with an external power supply; an accommodating connector having a LED driving module and plural orifices; plural lighting tubes inserted into the plural orifices, and each lighting tube having an opening; a plurality of self-adhesive substrates, each having a first circuit layer, a bending portion, and a second circuit layer electrically connected with the first circuit layer; plural first LED elements arranged on plural fixing plates and electrically connected with plural first circuit layers; plural second LED elements arranged on plural bending portions and electrically connected with plural second circuit layers; wherein the LED driving module controls the plural first LED elements and the plural second LED elements to illuminate lights; and a transparent lid covered on plural openings of the plural lighting tubes.

20 Claims, 20 Drawing Sheets

OMNIDIRECTIONAL LED LAMP

FIELD OF THE INVENTION

The present invention relates to an omnidirectional LED lamp which is simplified and is manufactured at low cost.

BACKGROUND OF THE INVENTION

Referring to FIGS. 1A and 1B, a conventional lamp contains a housing 11', plural lighting tubes 12', and an electrical connecting member 13', wherein each lighting tube 12' is in a U shape and has a filament fixed therein, mercury fed therein, and fluorescent substances coated thereon, thus illumining lights after connecting with an external power supply. Referring to FIG. 1B, another lamp 1' has a spiral lighting tube 12' formed thereon. However, such two conventional lamps cause electromagnetic waves to hurt user's body, and the mercury and UVs harms the user body as well. Likewise, color rendering index of the two conventional lamps are limited within 80 to 90, and the two conventional lamps are manufactured at high cost.

As shown in FIGS. 2A and 2B, a conventional LED lamp 2' contains: a holder 21', an insulation seat 22', four circuit boards 23', plural LED elements 24', and a cover 25'. The four circuit boards 23' are accommodated on an accommodating portion 211' of the holder 21' by means of the insulation seat 22'. The plural LED elements 24' are fixed on the four circuit boards 23' and are controlled by a circuit driving module 26' to illumine lights.

However, the conventional LED lamp 2' has following defects:

1. The lamp 2' does not contain any LED elements 24' arranged on a top end thereof, so it cannot illumine the lights omnidirectionally.

2. After illuminating the lights from the plural LED elements 24', heat from the plural LED elements 24' cannot be dissipated efficiently. In other words, the heat gathers on the four circuit boards 23' to damage the plural. LED elements 24' or the circuit driving module 26' easily. In addition, the holder 21' of FIG. 2B has a plurality of heat dissipation fins 212 formed around a peripheral side thereof, but the circuit board 23' is made of fiberglass material, thus conducting the heat difficulty.

3. Since the conventional LED lamp 2' cannot dissipate the heat effectively, it cannot be applied at high power (>20 W).

The present invention has arisen to mitigate and/or obviate the afore-described disadvantages.

SUMMARY OF THE INVENTION

The primary object of the present invention is to provide an omnidirectional LED lamp which is simplified and is manufactured at low cost.

Further object of the present invention is to provide an omnidirectional LED lamp which contains plural lighting tubes to dissipate heat from each first LED element quickly.

Another object of the present invention is to provide an omnidirectional LED lamp in which a support piece is retained among the plural lighting tubes, so when plural second LED elements and plural first LED elements illuminate lights, the omnidirectional LED lamp illumines the lights brightly and widely.

To obtain the above objective, an omnidirectional LED lamp provided by the present invention contains: a holder. The holder includes:

an electrical connecting member formed on a lower end thereof to couple with an external power supply;

an accommodating connector having a LED driving module accommodated therein and connected with the electrical connecting member, the accommodating connector also having plural orifices defined thereon;

plural lighting tubes inserted into the plural orifices, and each lighting tube having an opening formed thereon;

a plurality of self-adhesive substrates, each mounted on an inner wall of each lighting tube and having a first circuit layer arranged on a fixing plate thereof and electrically connected with the LED driving module; each self-adhesive substrate having a bending portion extending out of the opening, such that an angle is defined between the bending portion and the fixing plate; each self-adhesive substrate further having a second circuit layer formed thereon and electrically connected with the first circuit layer;

plural first LED elements arranged on plural fixing plates of the plurality of self-adhesive substrates and electrically connected with plural first circuit layers of the plurality of self-adhesive substrates;

plural second LED elements arranged on plural bending portions of the plurality of self-adhesive substrates and electrically connected with plural second circuit layers of the plurality of self-adhesive substrates; wherein the LED driving module controls the plural first LED elements and the plural second LED elements to illuminate lights;

a transparent lid covered on plural openings of the plural lighting tubes to protect the support piece and the plural second LED elements.

DETAILED DESCRIPTION OF THE PREFERRED EMBODIMENTS

Figure 1A:
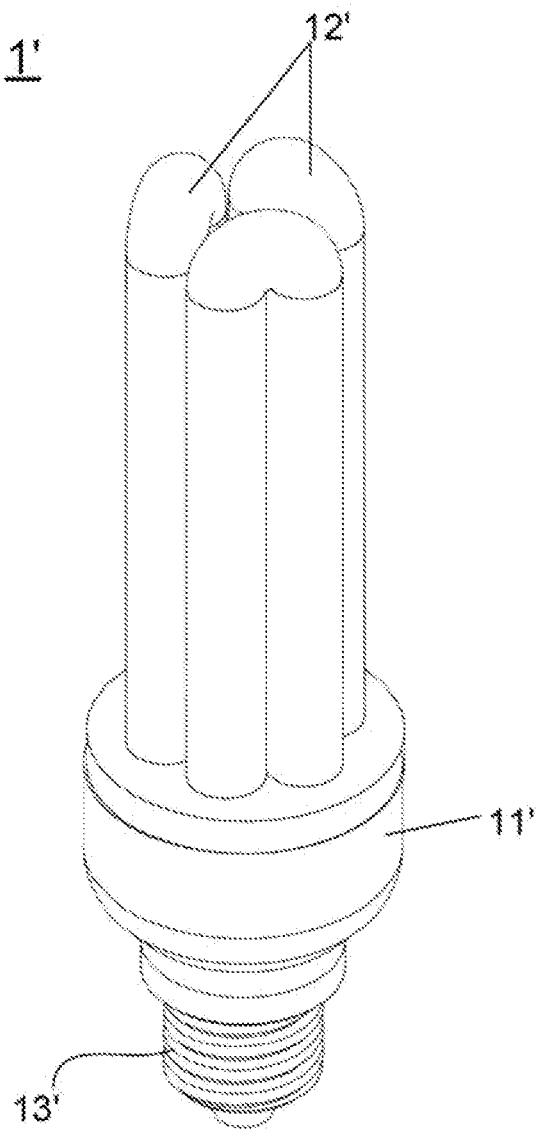
FIG. 1A is a perspective view of a conventional lamp.
Figure 1B:
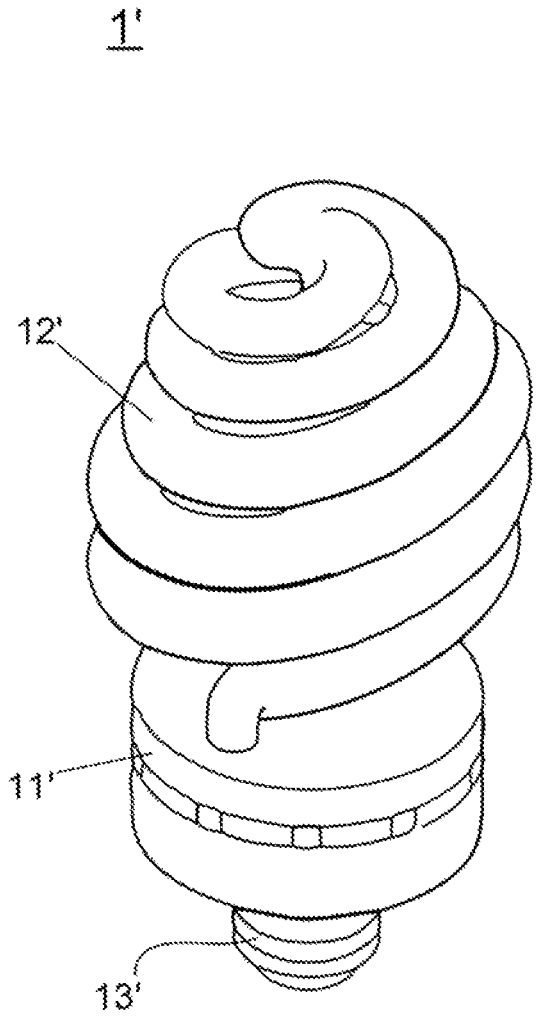
FIG. 1B is a perspective view of another conventional lamp.
Figure 2A:
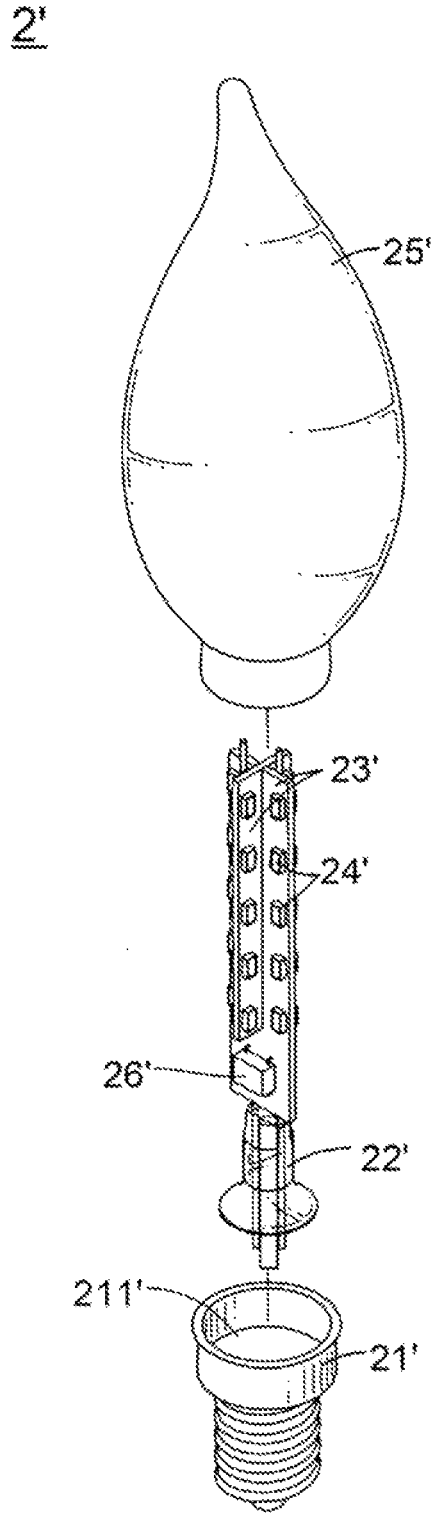
FIG. 2A is a perspective view of a conventional LED lamp.
Figure 2B:
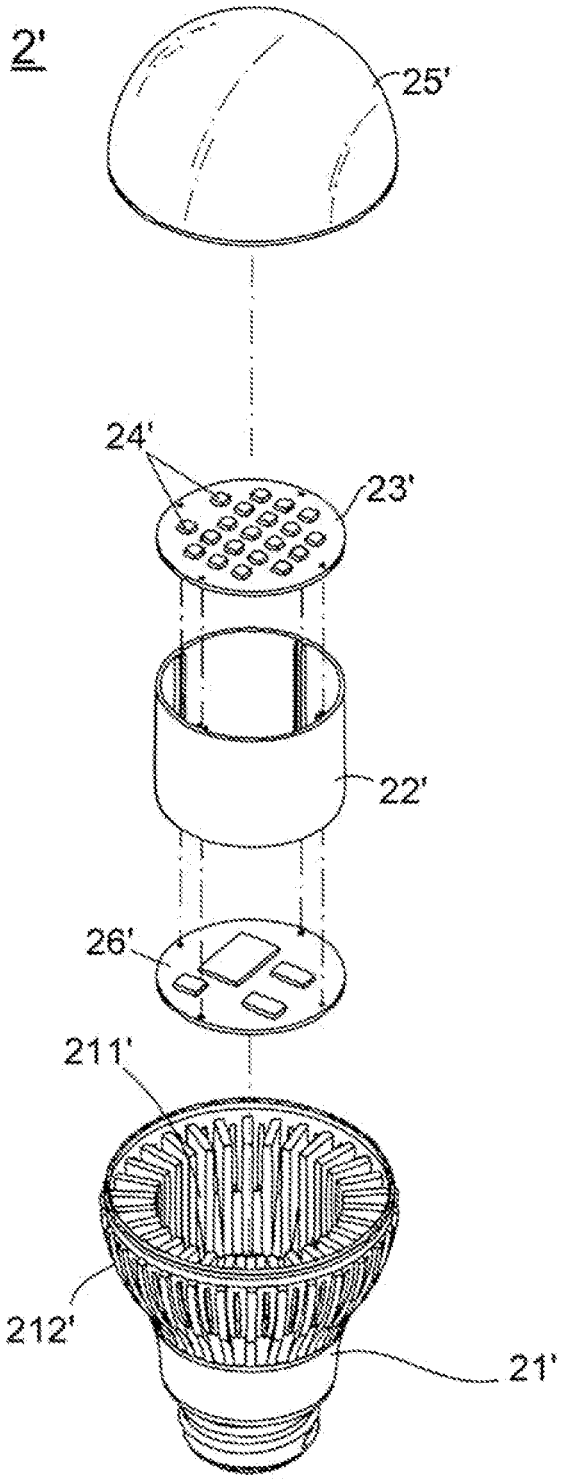
FIG. 2B is another perspective view of the conventional LED lamp.
Figure 3:
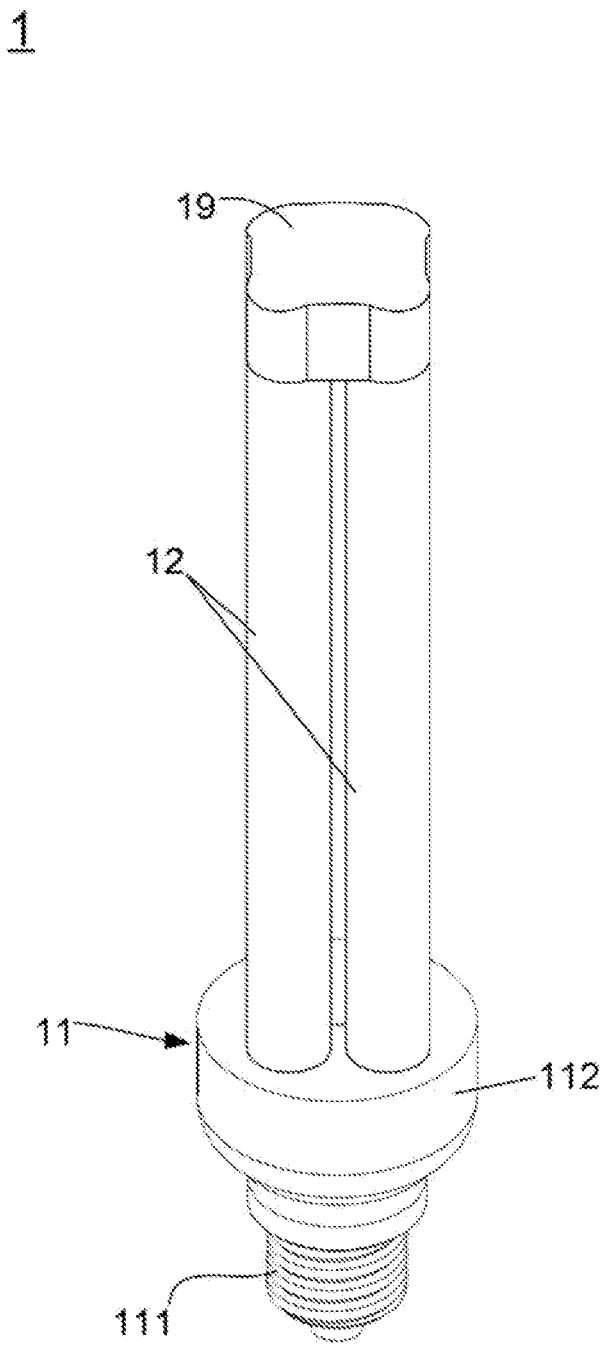
FIG. 3 is a perspective view showing the assembly of an omnidirectional LED lamp according to a first embodiment of the present invention.
Figure 4:
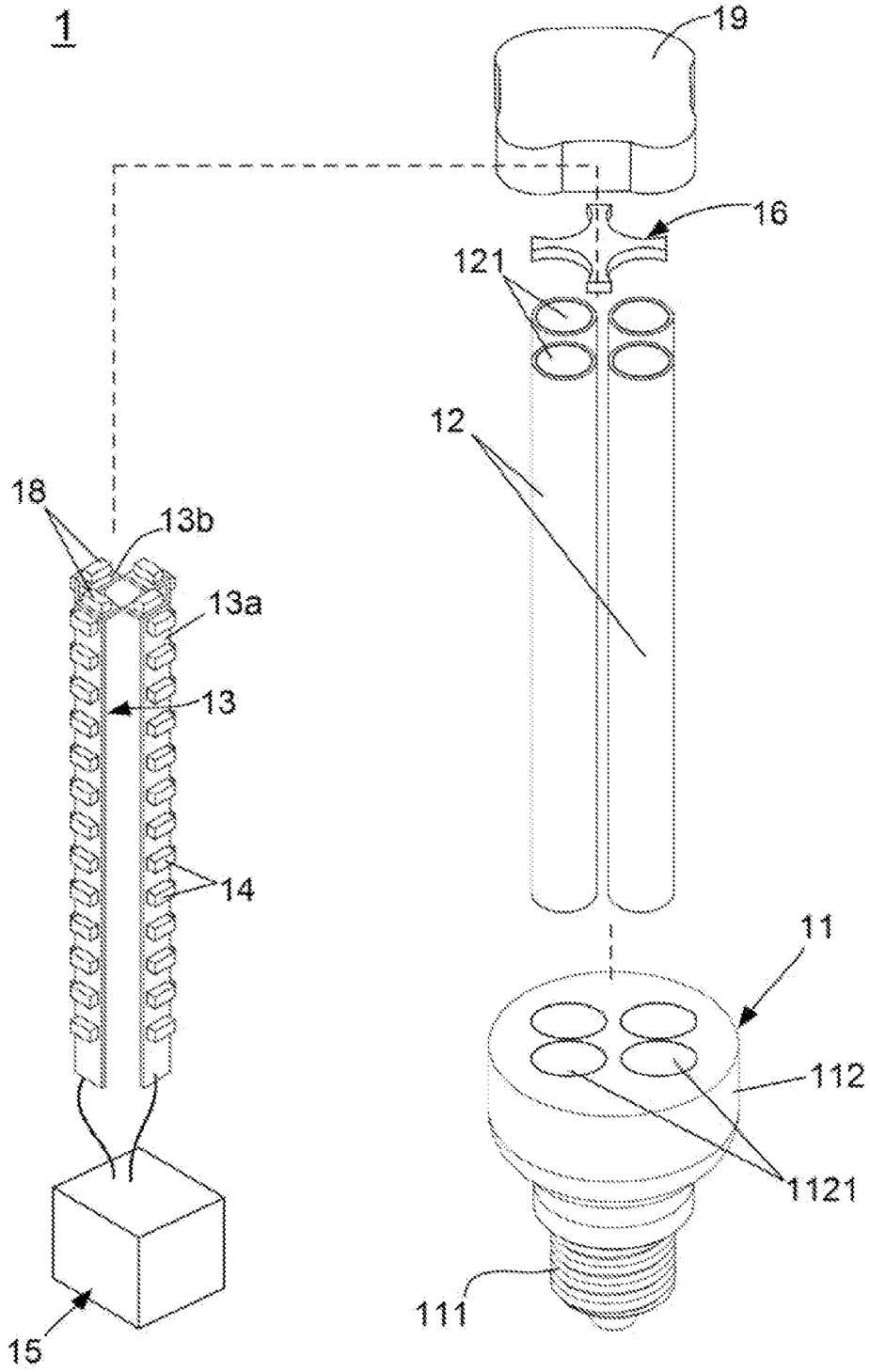
FIG. 4 is a perspective view showing the exploded components of the omnidirectional LED lamp according to the first embodiment of the present invention.
Figure 5:
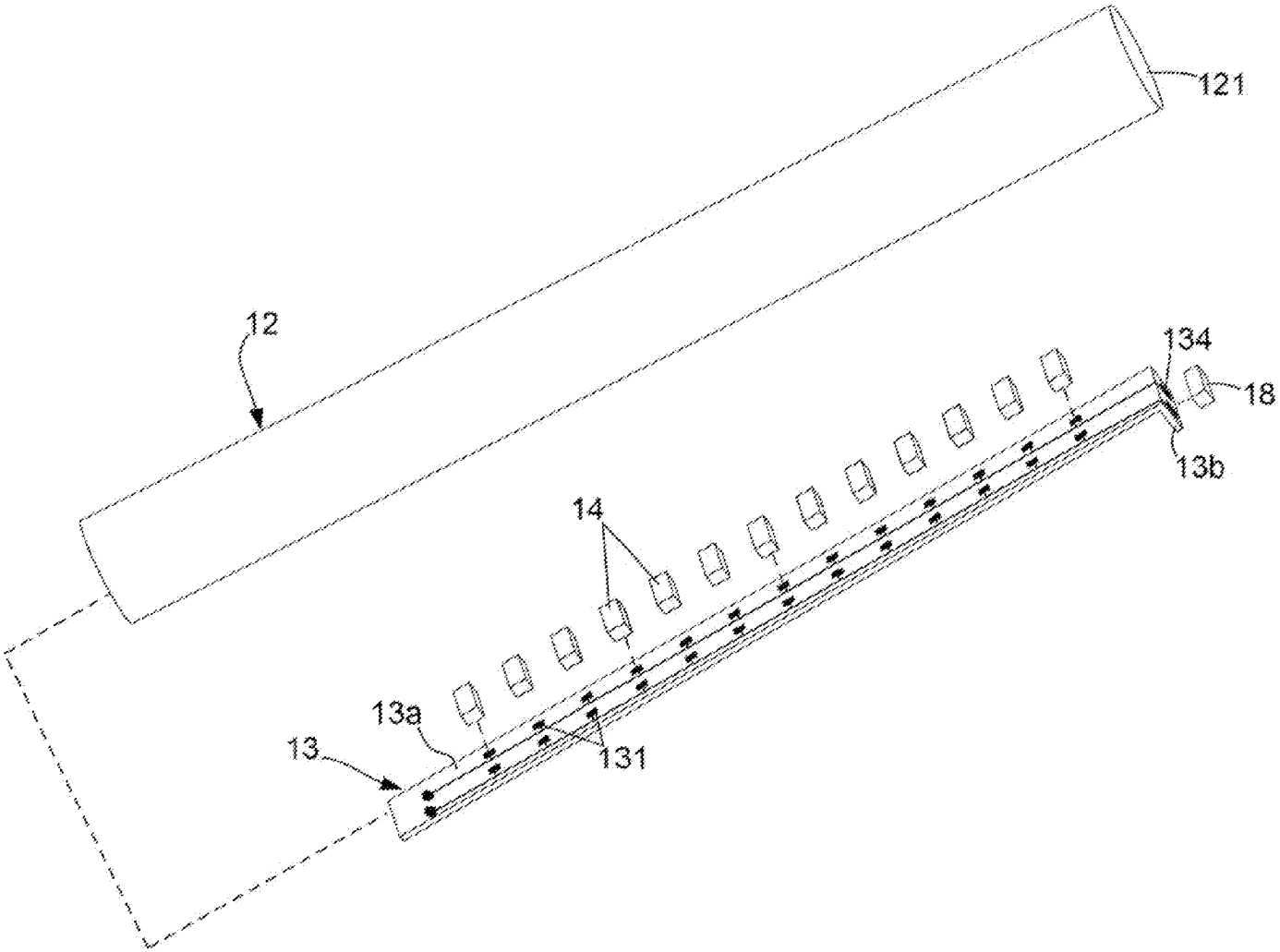
FIG. 5 is a perspective view showing the exploded components of a lighting tube of the omnidirectional LED lamp according to the first embodiment of the present invention.
Figure 6:
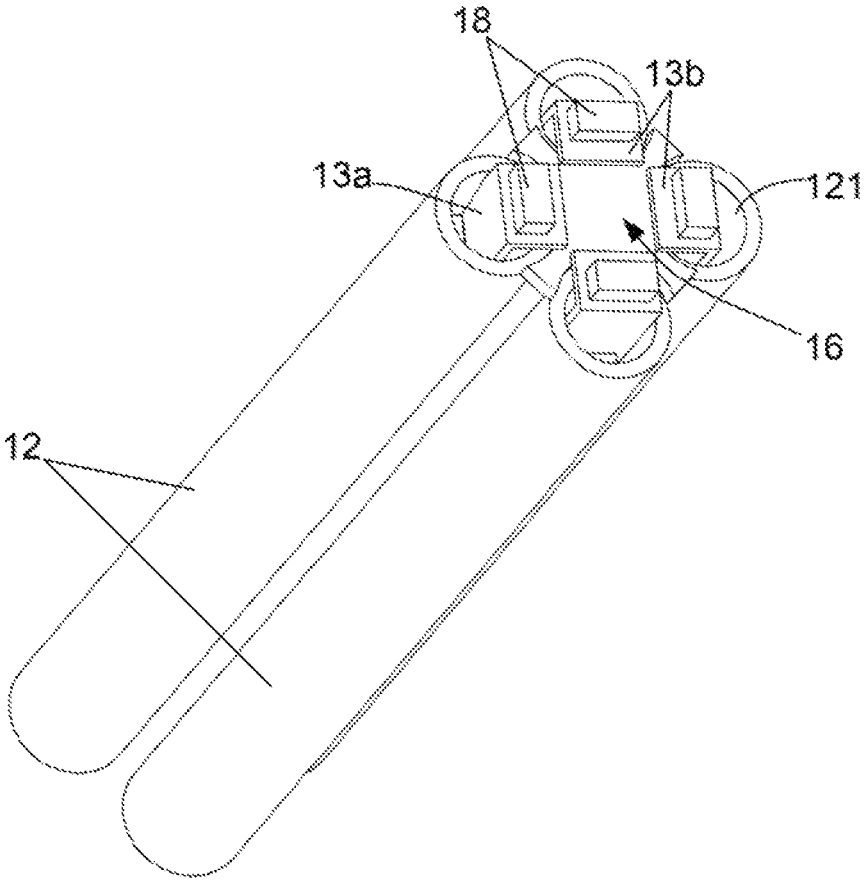
FIG. 6 is a perspective view showing the assembly of plural lighting tubes of the omnidirectional LED lamp according to the first embodiment of the present invention.

With reference to FIGS. 3 and 4, an omnidirectional LED lamp 1 according to a first embodiment of the present invention comprises: a holder 11, plural lighting tubes 12, a plurality of self-adhesive substrates 13, plural first LED elements 14, a support piece 16, plural second LED elements 18, and a transparent lid 19. The holder 11 includes an electrical connecting member 111 formed on a lower end thereof to couple with an external power supply, and the holder 11 also includes an accommodating connector 112 in which a LED driving module 15 is accommodated and is connected with the electrical connecting member 111, wherein the accommodating connector 112 has plural orifices 1121 defined thereon.

Referring further to FIGS. 3 to 6, the plural lighting tubes 12 are inserted into the plural orifices 1121 of the accommodating connector 112 of the holder 11, and each lighting tube 12 has an opening 121 formed thereon, each self-adhesive substrate 13 is mounted on an inner wall of each lighting tube 12 and has a first circuit layer 131 arranged on a fixing plate 13*a* thereof and electrically connected with the LED driving module 15; each self-adhesive substrate 13 also has a bending portion 13*b* extending out of the opening 121, such that an angle is defined between the bending portion 13*b* and the fixing plate 13*a*; each self-adhesive substrate 13 further has a second circuit layer 134 formed thereon and electrically connected with the first circuit layer 131.

The plural first LED elements 14 are arranged on plural fixing plates 13*a* of the plurality of self-adhesive substrates 13 and are electrically connected with plural first circuit layers 131 of the plurality of self-adhesive substrates 13. The plural second LED elements 18 are arranged on plural bending portions 13*b* of the plurality of self-adhesive substrates 13 and are electrically connected with plural second circuit layers 134 of the plurality of self-adhesive substrates 13. As shown in FIG. 4, the bending portion 13*b* and the fixing plate 13*a* are connected together to form a L-shaped self-adhesive substrate, such that when the LED driving module 15 controls the plural first LED elements 14 and the plural second LED elements 18 to illuminate lights, the plural first LED elements 14 project the lights out of a peripheral side of the omnidirectional LED lamp 1, and the plural second LED elements 18 project the lights out of a top end of the omnidirectional LED lamp 1, thus illuminating the lights omnidirectionally. Furthermore, the holder 11 also includes a vibration sensor (not shown) fixed therein and coupled with the LED driving module 15, such that when the vibration sensor senses a vibration of the omnidirectional LED lamp 1, it breaks an electrical connection of the LED driving module 15, the plural first LED elements 14, and the plural second LED elements 18, thus preventing electric shock to a user.

Figure 7:
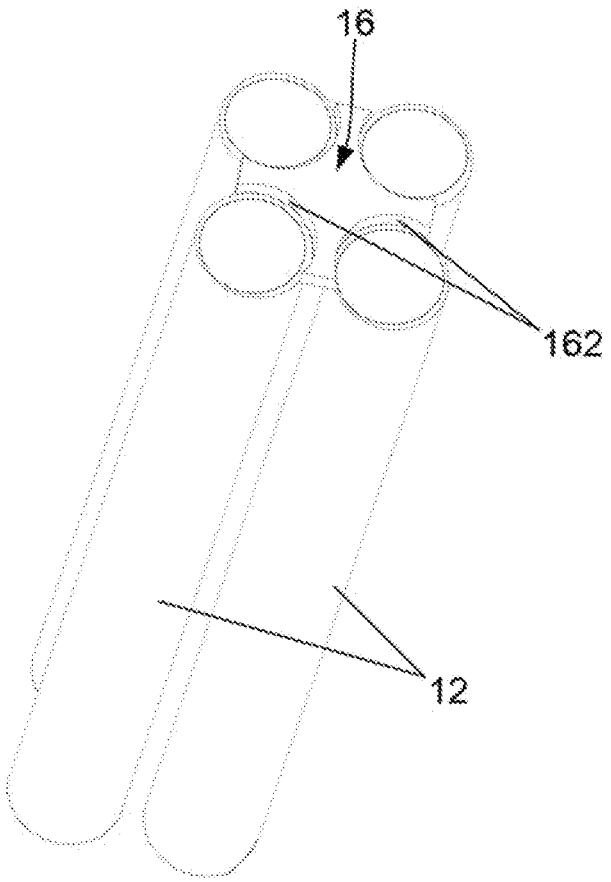
FIG. 7 is a perspective view showing the assembly of the plural lighting tube and a support piece of the omnidirectional LED lamp according to the first embodiment of the present invention.

As illustrated in FIG. 7, the support piece 16 has plural recesses 162 for retaining with the plural lighting tubes 12, such that the support piece 16 is defined among the plural lighting tubes 12 and is located adjacent to top ends of the plural lighting tubes 12 to fix plural bending portions 13*b* of the plurality of self-adhesive substrates 13. Preferably, the transparent lid 19 is covered on plural openings 121 of the plural lighting tubes 12 to protect the support piece 16 and the plural second LED elements 18.

Figure 8A:
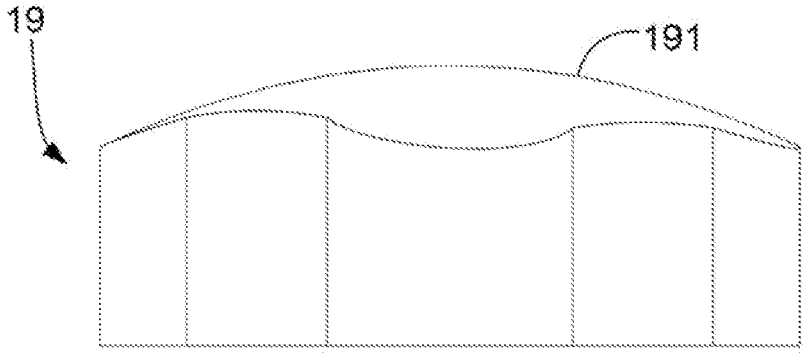
FIG. 8A is a perspective view showing the assembly of a transparent lid of the omnidirectional LED lamp according to the first embodiment of the present invention.
Figure 8B:
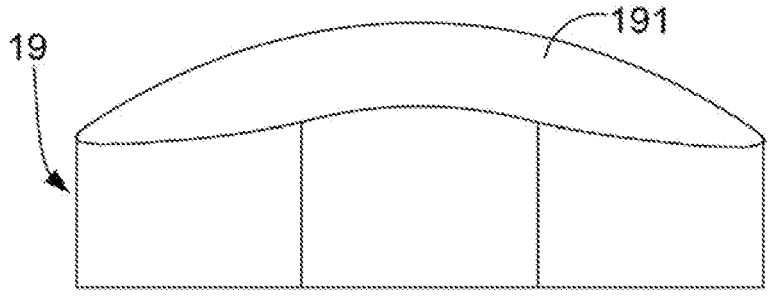
FIG. 8B is another perspective view showing the assembly of the transparent lid of the omnidirectional LED lamp according to the first embodiment of the present invention.

With reference to FIGS. 8A and 8B, the transparent lid 19 includes an optical lens 191 formed on a top end thereof to illuminate the lights of the plural second LED elements 18 at a largest angle, wherein the optical lens 191 is a LED astigmatic lens (such as a convex lens) and is made of light-diffusing material.

Figure 9:
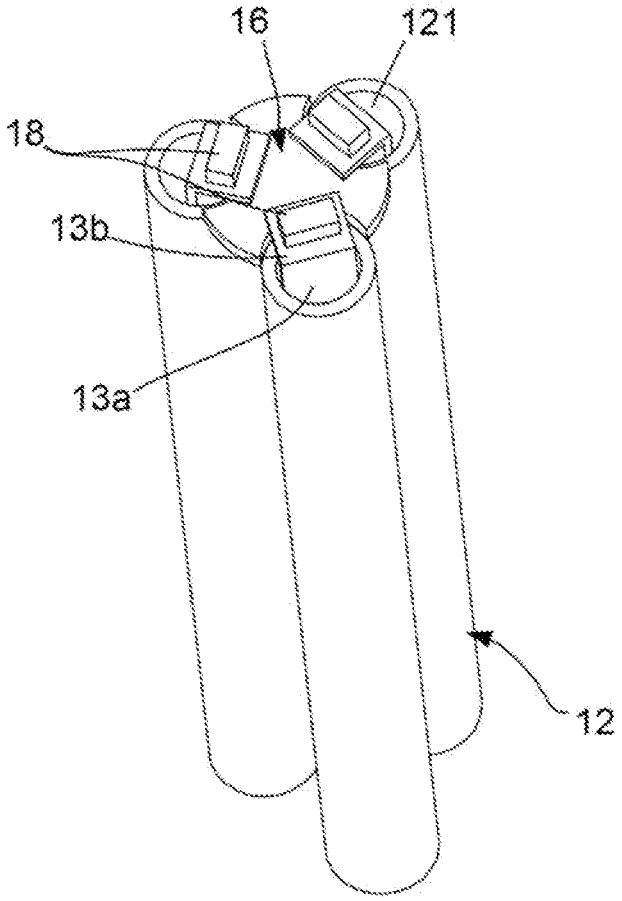
FIG. 9 is a perspective view showing the assembly of an omnidirectional LED lamp according to a second embodiment of the present invention.

It is to be noted that a number of the plural lighting tubes 12 is adjusted based on wattage of the omnidirectional LED lamp 1. For example, when the wattage of the omnidirectional LED lamp 1 is 20 watts, the number of the plural lighting tubes 12 is four; when the wattage of the omnidirectional LED lamp 1 is 15 watts, the number of the plural lighting tubes 12 is three, as shown in FIG. 9, such that the omnidirectional LED lamp 1 illuminates the lights in a long time, and each first LED element 14 does not cause a high heat. In addition, each first LED element 14 is attached on the inner wall of each lighting tube 12 by ways of each self-adhesive substrate 13, so heat from each first LED element 14 dissipates to air via each lighting tube 12, thereby avoiding overheat in each lighting tube 12. In other words, the heat from each first LED element 14 conducts to each lighting tube 12 made of glass material by using each self-adhesive substrate 13, and then the heat is dissipated quickly by each lighting tube 12.

Preferably, each lighting tube 12 of FIG. 3 and FIG. 9 further includes an aperture defined on a bottom end thereof, and the bottom end of each lighting tube 12 is inserted into each orifice 1121 of the accommodating connector 112. Preferably, a light-diffusing material is coated on the inner wall or an outer wall of each lighting tube 12 to increase a lighting angle of each first LED element 14. Moreover, each lighting tube 12 is made of transparent plastic material to scatter the lights.

When each lighting tube 12 is not coated the light-diffusing material and is made of the glass material, a light-diffusion protective film covers around it. When each lighting tube 12 is coated the light-diffusing material and is made of the glass material, a transparent protective film covers around it. However, when each lighting tube is made of plastic material, a protective film is eliminated. The protective film can be also coated on each lighting tube 12 is soaked in a glue to form the protective film around it.

Figure 10A:
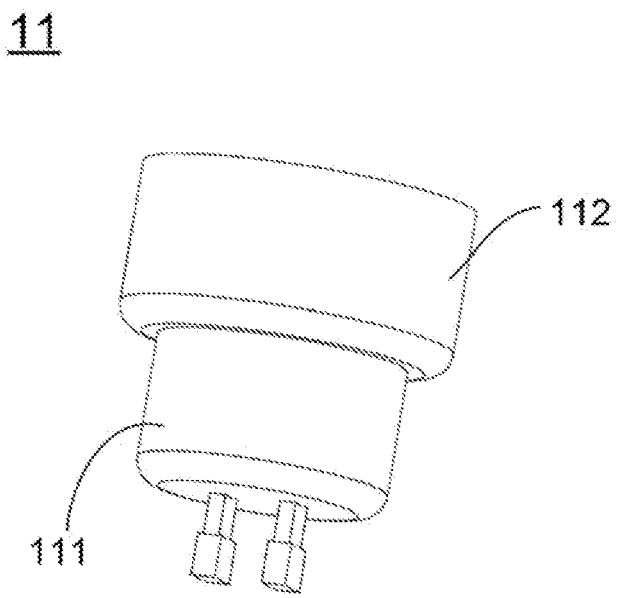
FIG. 10A is a perspective view showing the assembly of a holder of an omnidirectional LED lamp according to a third embodiment of the present invention.
Figure 10B:
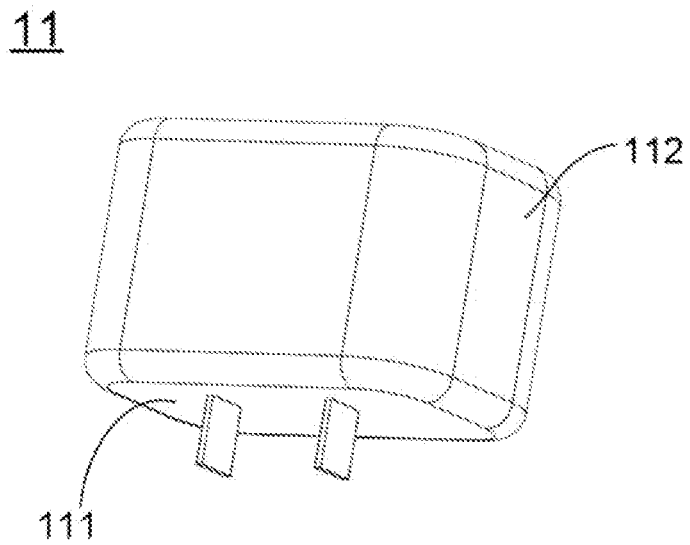
FIG. 10B is a perspective view showing the assembly of a holder of an omnidirectional LED lamp according to a fourth embodiment of the present invention.

As illustrated in FIGS. 3 and 4, the electrical connecting member 111 of the holder 11 is a rotatable knob. As shown in FIG. 10A, the electrical connecting member 111 has two electrical connection terminals inserted into two grooves of the external power supply. As illustrated in FIG. 10B, the holder 11 is formed in a cube shape.

Figure 11:
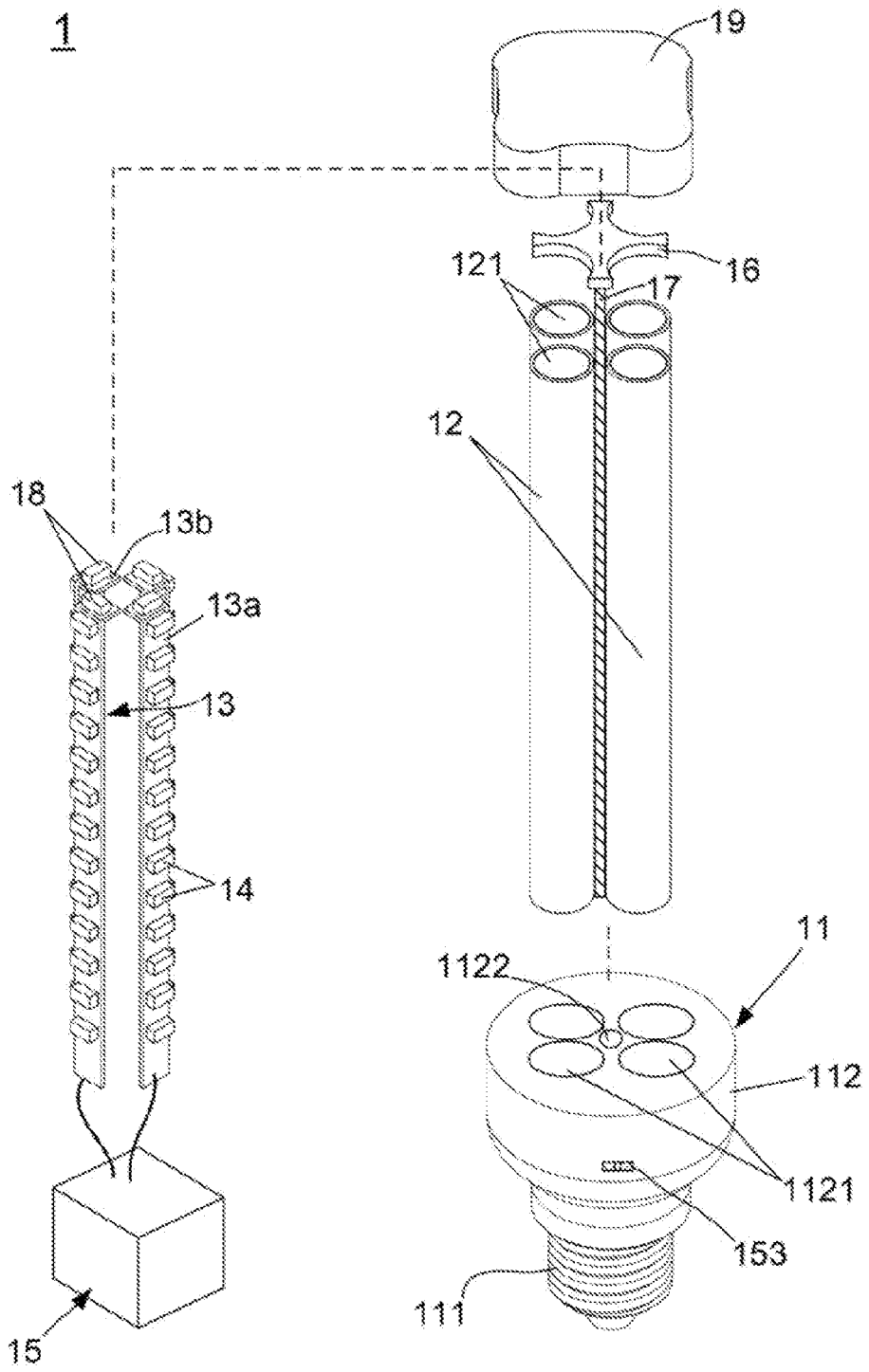
FIG. 11 is a perspective view showing the exploded components of a lighting tube of an omnidirectional LED lamp according to a fifth embodiment of the present invention.

With reference to FIG. 11, an omnidirectional LED lamp 1 according to a fifth embodiment of the present invention comprises: a holder 11, plural lighting tubes 12, a plurality of self-adhesive substrates 13, plural first LED elements 14, a support piece 16, a mounting member 17, plural second LED elements 18, and a transparent lid 19. In other words, a difference of the omnidirectional LED lamp 1 of the fifth embodiment from that of the first embodiment comprises: a pore 1122 defined on the accommodating connector 112 of the holder 11 to retain with a first end of the mounting member 17, thus fixing the mounting member 17 on the accommodating connector 112. In addition, a second end of the mounting member 17 is connected with the support piece 16.

Figure 12:
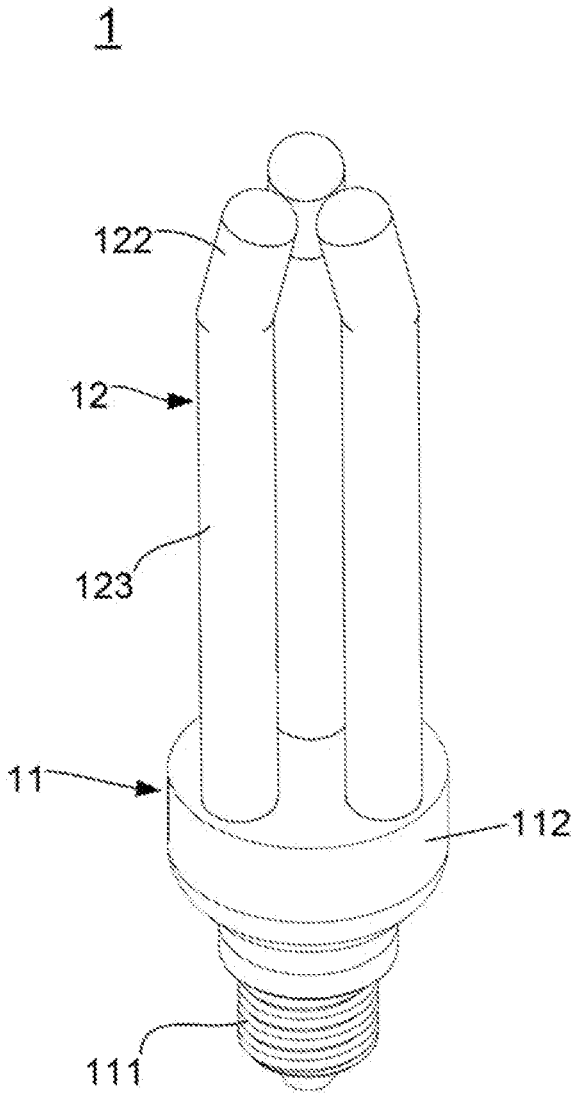
FIG. 12 is a perspective view showing the assembly of an omnidirectional LED lamp according to a sixth embodiment of the present invention.
Figure 13:
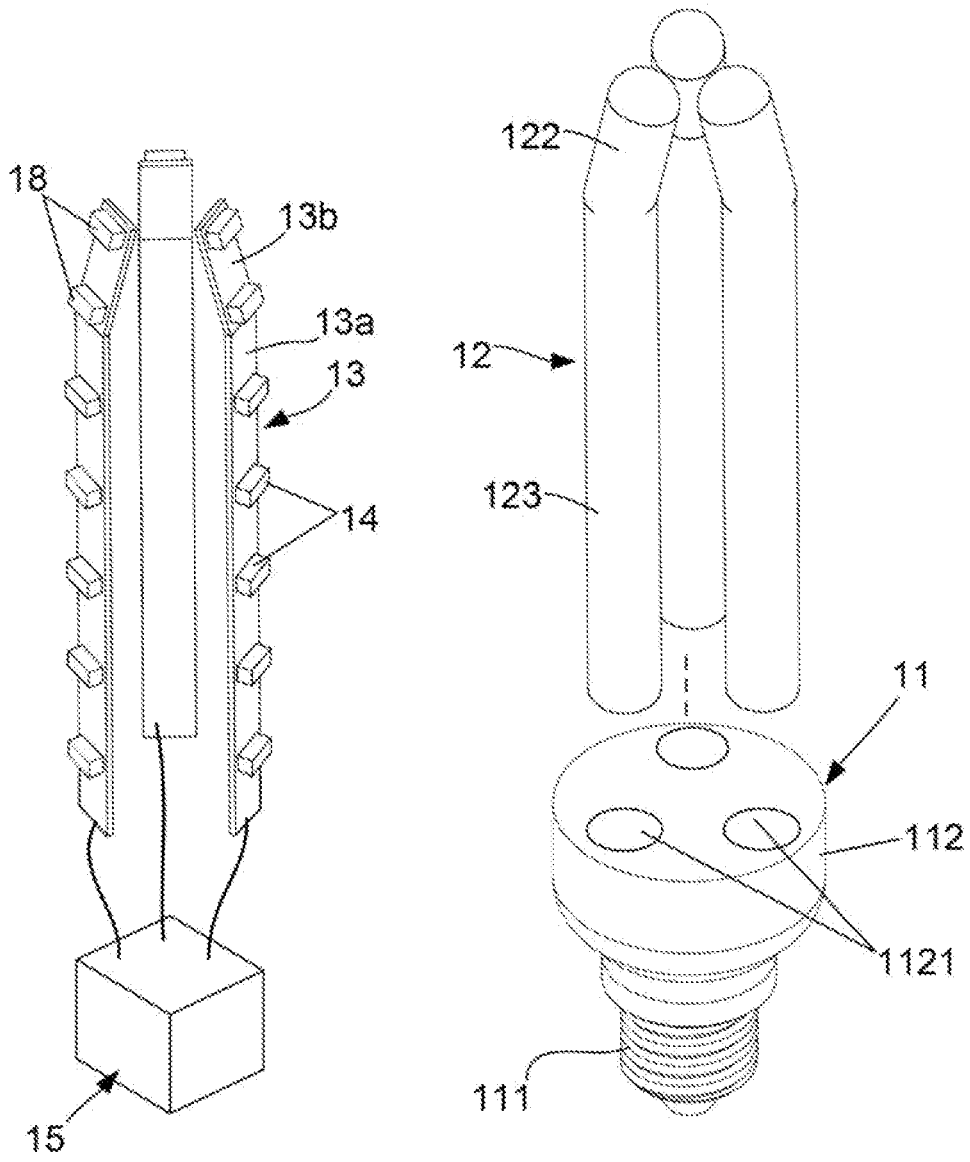
FIG. 13 is a perspective view showing the exploded components of the omnidirectional LED lamp according to the sixth embodiment of the present invention.

With reference to FIGS. 12 and 13, an omnidirectional LED lamp 1 according to a sixth embodiment of the present invention comprises: a holder 11, plural lighting tubes 12, a plurality of self-adhesive substrates 13, plural first LED elements 14, and plural second LED elements 18, wherein the holder 11 includes an electrical connecting member 111 formed on a lower end thereof to couple with an external power supply, and the holder 11 also includes an accommodating connector 112 in which a LED driving module 15 is accommodated and is connected with the electrical connecting member 111, the accommodating connector 112 has plural orifices 1121 defined thereon to insert the plural lighting tubes 12. Preferably, each lighting tube 12 has a hollow body 123 and a hollowly curved segment 122 extending upwardly.

Figure 14:
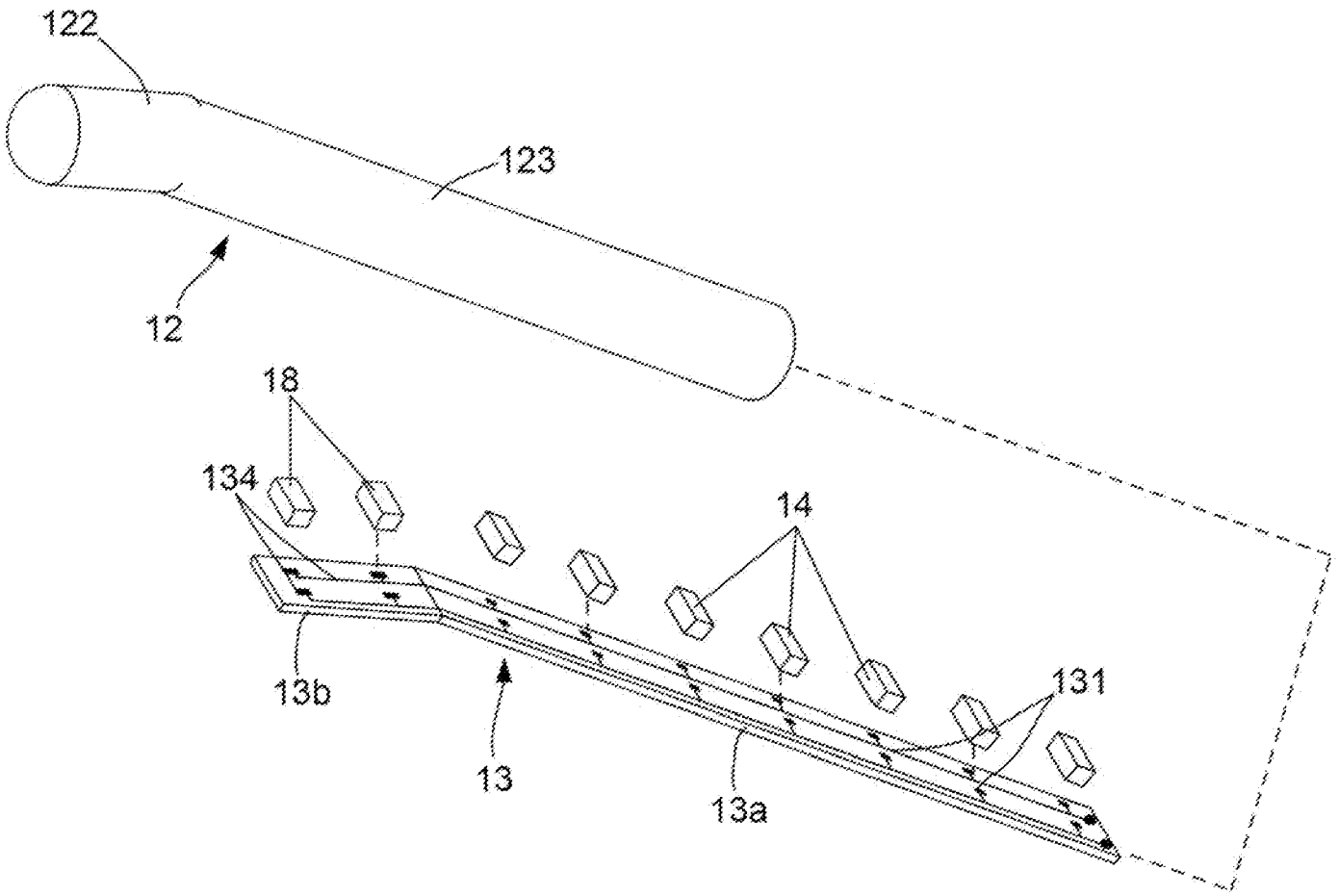
FIG. 14 is a perspective view showing the exploded components of a lighting tube and a plurality of self-adhesive substrates of the omnidirectional LED lamp according to the sixth embodiment of the present invention.

Referring to FIGS. 12 to 14, each self-adhesive substrate 13 is mounted on an inner wall of each lighting tube 12 and has a fixing plate 13*a* and a bending portion 13*b*, wherein the fixing plate 13*a* is fixed in the hollow body 123 and has a first circuit layer 131 electrically connected with the LED driving module 15, and an angle is defined between the fixing plate 13*a* and the bending portion 13*b*, the bending portion 13*b* is mounted in the hollowly curved segment 122 and has a second circuit layer 134 electrically connected with the first circuit layer 131 and the LED driving module 15.

The plural first LED elements 14 are arranged on plural fixing plates 13*a* of the plurality of self-adhesive substrates 13 and are electrically connected with plural first circuit layers 131, and plural second LED elements 18 are arranged on plural bending portions 13*b* of the plurality of self-adhesive substrates 13 and are electrically connected with plural second circuit layers 134. As shown in FIG. 13, each fixing plates 13*a* and each bending portion 13*b* are coupled together to form each curved self-adhesive substrate 13 so that when the LED driving module 15 controls each first LED element 14 and each second LED element 18 to illuminate lights, each first LED element 14 projects the lights out of a peripheral side of the omnidirectional LED lamp 1, and each second LED element 18 projects the lights out of a top end of the omnidirectional LED lamp 1, thus illuminating the lights omnidirectionally.

Figure 15:
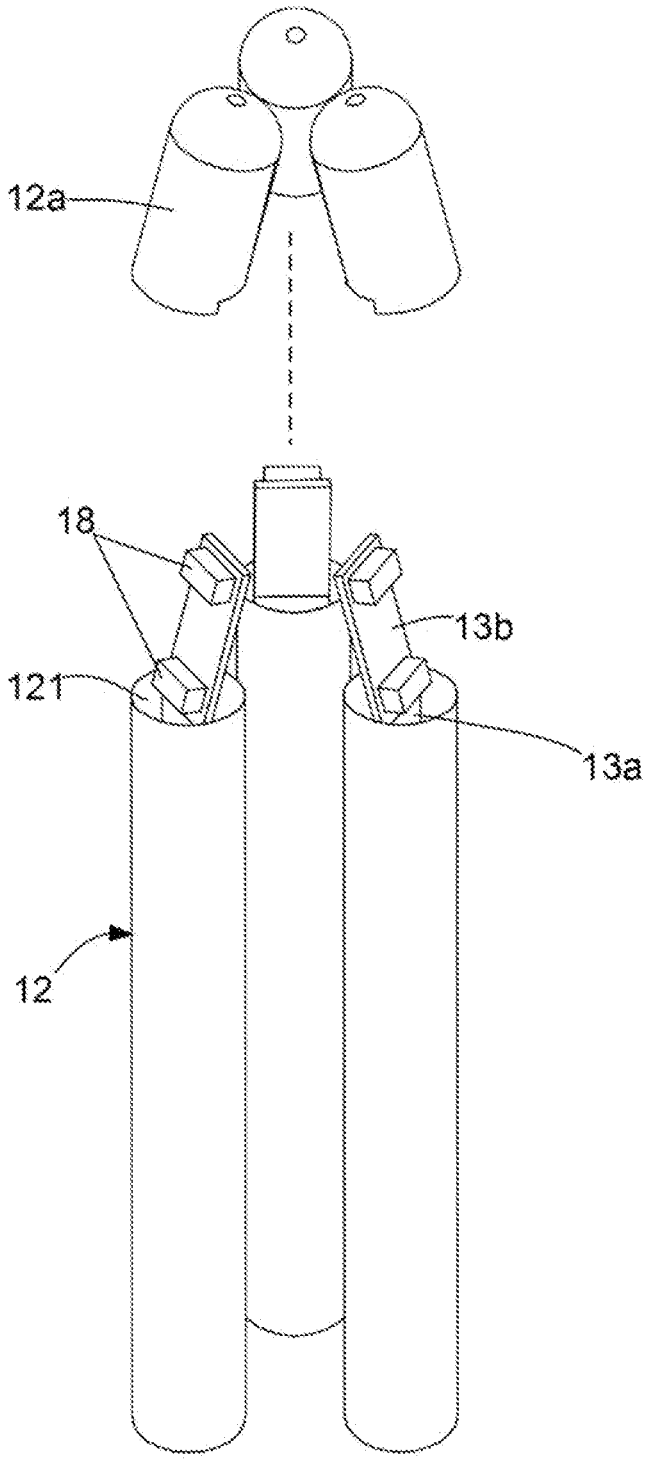
FIG. 15 is a perspective view showing the exploded components of plural lighting tubes and a plurality of self-adhesive substrates of the omnidirectional LED lamp according to a seventh embodiment of the present invention.

As shown in FIG. 15, a difference of an omnidirectional LED lamp 1 of a seventh embodiment from that of the sixth embodiment comprises: each lighting tube 12 having an opening 121 formed on a first end thereof to expose the bending portion 13*b* of each self-adhesive substrate 13 outside the hollow body 123 of each lighting tube 12, and each lighting tube 12 also having an aperture formed on a second end thereof, the second end of each lighting tube 12 being inserted into each orifice 1121 of the accommodating connector 112. Preferably, a transparent socket 12*a* is fitted with the opening 121 of each lighting tube 12 to replace the hollowly curved segment 122 of the sixth embodiment.

Thereby, the omnidirectional LED lamp 1 of the present invention has advantages as follows:

1. The omnidirectional LED lamp 1 is simplified and is manufactured at low cost.

2. The omnidirectional LED lamp 1 comprises the plural lighting tubes 12 to dissipate the heat from each first LED element 14 quickly.

3. The support piece 16 is retained among the plural lighting tubes 12, so when the plural second LED elements 18 and the plural first LED elements 14 illuminate the lights, the omnidirectional LED lamp 1 illumines the lights brightly and widely.

Figure 16:
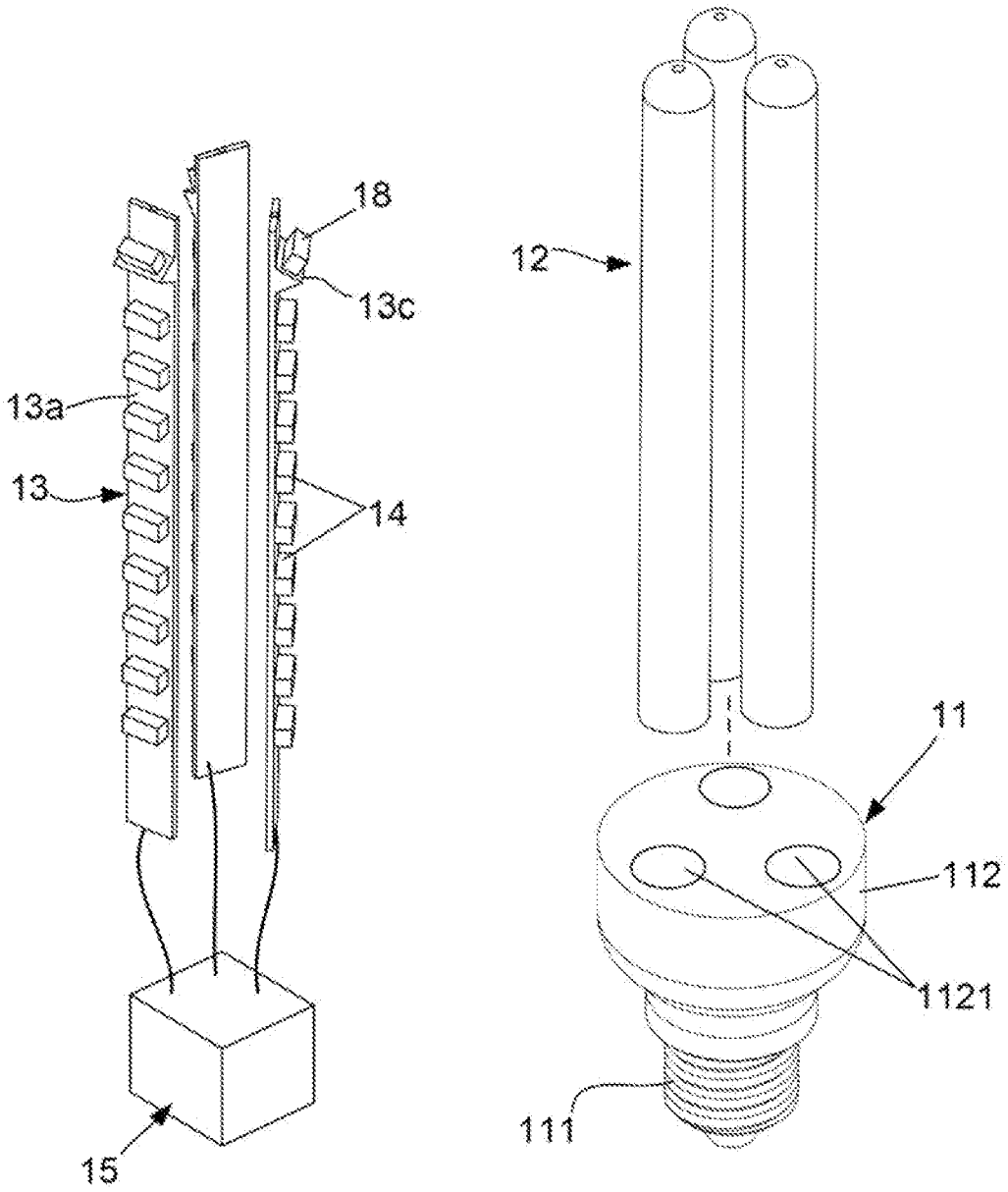
FIG. 16 is a perspective view showing the exploded components of an omnidirectional LED lamp according to an eighth embodiment of the present invention.
Figure 17:
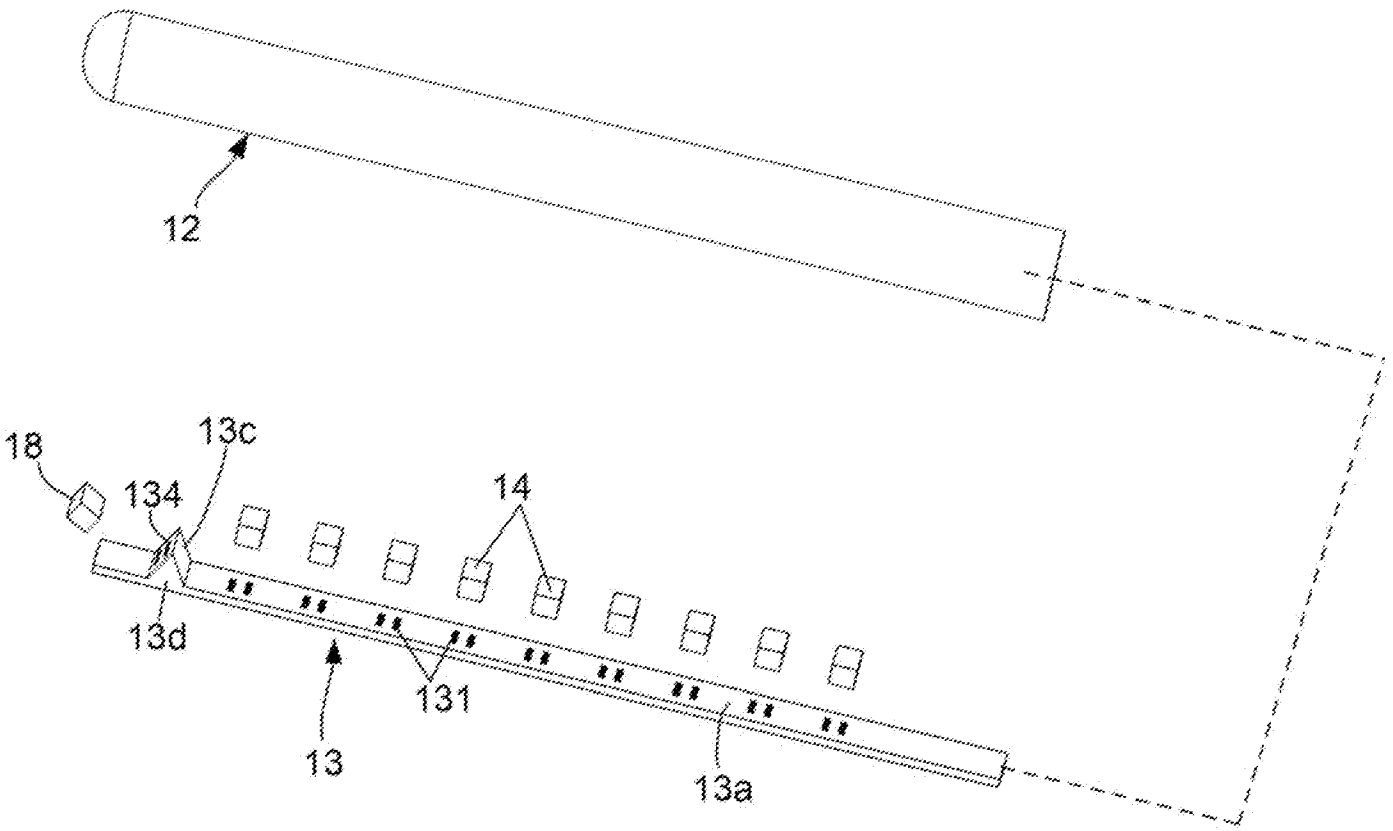
FIG. 17 is another perspective view showing the exploded components of the omnidirectional LED lamp according to the eighth embodiment of the present invention.

With reference to FIGS. 16 and 17, a difference of an omnidirectional LED lamp 1 of an eighth embodiment from that of the first embodiment comprises: each self-adhesive substrate 13 having a fixing plate 13*a* and a raised portion 13*c*.

The fixing plates 13*a* has a first circuit layer 131 arranged thereon and electrically connected with a LED driving module 15, and the raised portion 13*c* has a second circuit layer 134 electrically connected with the first circuit layer 131 and the LED driving module 15. In addition, each first LED element 14 is arranged on the fixing plate 13*a* of each self-adhesive substrate 13 and is electrically in connection with the first circuit layer 131. Each second LED element 18 is arranged on the raised portion 13*c* of each self-adhesive substrate 13 and is electrically coupled with the second circuit layer 134. It is to be noted that the raised portion 13*c* is formed in a V shape and has a bottom end supported by a holding protrusion 13*d*. The holding protrusion 13*d* is formed in a triangle shape in this embodiment, but it can be bent in an inverted V shape from aluminum martial or thermal conductivity material, such that each second LED element 18 illuminates the lights upwardly to each lighting tube 12, and each first LED element 14 illuminates the lights to the peripheral side of each lighting tube 12, thus illuminating the lights omnidirectionally.

Figure 18:
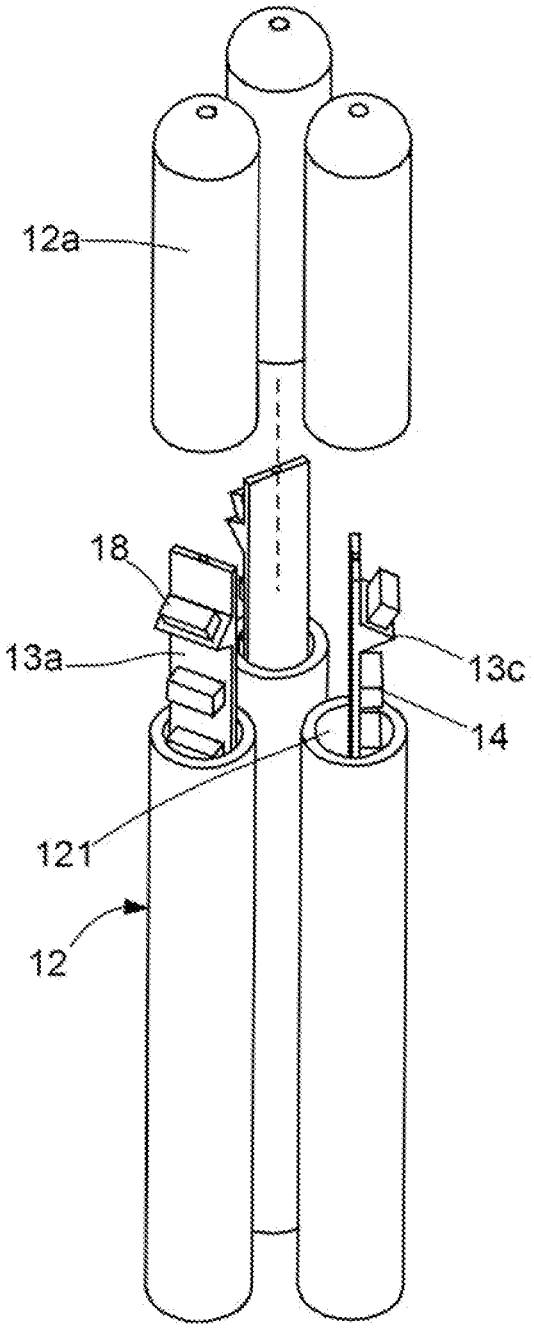
FIG. 18 is a perspective view showing the exploded components of an omnidirectional LED lamp according to a ninth embodiment of the present invention.

Furthermore, as shown in FIG. 18, each lighting tube 12 having an opening 121 formed on one end thereof to expose the raised portion 13*c* of each self-adhesive substrate 13, and a transparent socket 12*a* is fitted with the opening 121 of each lighting tube 12.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An omnidirectional LED lamp comprising:

a holder including:

an electrical connecting member formed on a lower end thereof to couple with an external power supply;

an accommodating connector having a LED driving module accommodated therein and connected with the electrical connecting member, the accommodating connector also having plural orifices defined thereon;

plural lighting tubes inserted into the plural orifices, and each lighting tube having an opening formed thereon;

a plurality of self-adhesive substrates, each mounted on an inner wall of each lighting tube and having a first circuit layer arranged on a fixing plate thereof and electrically connected with the LED driving module; each self-adhesive substrate having a bending portion extending out of the opening, such that an angle is defined between the bending portion and the fixing plate; each self-adhesive substrate further having a second circuit layer formed thereon and electrically connected with the first circuit layer;

plural first LED elements arranged on plural fixing plates of the plurality of self-adhesive substrates and electrically connected with plural first circuit layers of the plurality of self-adhesive substrates;

plural second LED elements arranged on plural bending portions of the plurality of self-adhesive substrates and electrically connected with plural second circuit layers of the plurality of self-adhesive substrates; wherein the LED driving module controls the plural first LED elements and the plural second LED elements to illuminate lights;

a transparent lid covered on plural openings of the plural lighting tubes to protect the support piece and the plural second LED elements.

2. The omnidirectional LED lamp as claimed in claim 1 further comprising a support piece and a mounting member, wherein the support piece is defined among the plural lighting tubes and is located adjacent to top ends of the plural lighting tubes to fix plural bending portions of the plurality of self-adhesive substrates, the accommodating connector has a pore defined thereon to retain with a first end of the mounting member, and a second end of the mounting member is connected with the support piece.

3. The omnidirectional LED lamp as claimed in claim 1 further comprising a vibration sensor fixed therein and coupled with the LED driving module, such that when the vibration sensor senses a vibration of the omnidirectional LED lamp, it breaks an electrical connection of the LED driving module, the plural first LED elements, and the plural second LED elements.

4. The omnidirectional LED lamp as claimed in claim 1, wherein each lighting tube further includes an aperture defined on a bottom end thereof, and the bottom end of each lighting tube is inserted into each orifice of the accommodating connector.

5. The omnidirectional LED lamp as claimed in claim 1, wherein the electrical connecting member of the holder is a rotatable knob or has two electrical connection terminals.

6. The omnidirectional LED lamp as claimed in claim 1, wherein the support piece has plural recesses for retaining with the plural lighting tubes.

7. The omnidirectional LED lamp as claimed in claim 1, wherein each lighting tube is made of glass material or plastic material.

8. The omnidirectional LED lamp as claimed in claim 1, wherein a light-diffusing material is coated on the inner wall or an outer wall of each lighting tube.

9. An omnidirectional LED lamp comprising:

a holder including:

an electrical connecting member formed on a lower end thereof to couple with an external power supply;

an accommodating connector having a LED driving module accommodated therein and connected with the electrical connecting member, the accommodating connector also having plural orifices defined thereon;

plural lighting tubes inserted into the plural orifices, and each lighting tube having a hollow body and a hollowly curved segment extending upwardly;

a plurality of self-adhesive substrates, each mounted on an inner wall of each lighting tube and having: a fixing plate fixed in the hollow body and having a first circuit layer electrically connected with the LED driving module; a bending portion mounted in the hollowly curved segment and having a second circuit layer electrically connected with the first circuit layer and the LED driving module; wherein an angle is defined between the fixing plate and the bending portion;

plural first LED elements arranged on plural fixing plates of the plurality of self-adhesive substrates and electrically connected with plural first circuit layers of the plurality of self-adhesive substrates;

plural second LED elements arranged on plural bending portions of the plurality of self-adhesive substrates and electrically connected with plural second circuit layers of the plurality of self-adhesive substrates; wherein the LED driving module controls the plural first LED elements and the plural second LED elements to illuminate lights.

10. The omnidirectional LED lamp as claimed in claim 9 further comprising a vibration sensor fixed therein and coupled with the LED driving module, such that when the vibration sensor senses a vibration of the omnidirectional LED lamp, it breaks an electrical connection of the LED driving module, the plural first LED elements, and the plural second LED elements.

11. The omnidirectional LED lamp as claimed in claim 9, wherein each lighting tube has an opening formed on a first end thereof to fitted with a transparent socket, and each lighting tube also has an aperture formed on a second end thereof, the second end of each lighting tube is inserted into each orifice of the accommodating connector.

12. The omnidirectional LED lamp as claimed in claim 9, wherein the electrical connecting member of the holder is a rotatable knob or has two electrical connection terminals.

13. The omnidirectional LED lamp as claimed in claim 9, wherein each lighting tube is made of glass material or plastic material.

14. The omnidirectional LED lamp as claimed in claim 9, wherein a light-diffusing material is coated on the inner wall or an outer wall of each lighting tube.

15. An omnidirectional LED lamp comprising:

a holder including:

an electrical connecting member formed on a lower end thereof to couple with an external power supply;

an accommodating connector having a LED driving module accommodated therein and connected with the electrical connecting member, the accommodating connector also having plural orifices defined thereon;

plural lighting tubes inserted into the plural orifices, and each lighting tube having a hollow body and a hollowly curved segment extending upwardly;

a plurality of self-adhesive substrates, each mounted on an inner wall of each lighting tube and having:

a fixing plate having a first circuit layer arranged thereon and electrically connected with the LED driving module;

a raised portion electrically coupled with the first circuit layer and having a second circuit layer electrically connected with the first circuit layer and the LED driving module;

plural first LED elements arranged on plural fixing plates of the plurality of self-adhesive substrates and electrically connected with plural first circuit layers of the plurality of self-adhesive substrates;

plural second LED elements arranged on plural raised portions of the plurality of self-adhesive substrates and electrically connected with plural second circuit layers of the plurality of self-adhesive substrates; wherein the LED driving module controls the plural first LED elements and the plural second LED elements to illuminate lights.

16. The omnidirectional LED lamp as claimed in claim 15 further comprising a vibration sensor fixed therein and coupled with the LED driving module, such that when the vibration sensor senses a vibration of the omnidirectional LED lamp, it breaks an electrical connection of the LED driving module, the plural first LED elements, and the plural second LED elements.

17. The omnidirectional LED lamp as claimed in claim 15, wherein each lighting tube has an opening formed on one end thereof, and a transparent socket is fitted with the opening of each lighting tube.

18. The omnidirectional LED lamp as claimed in claim 15, wherein the electrical connecting member of the holder is a rotatable knob or has two electrical connection terminals.

19. The omnidirectional LED lamp as claimed in claim 15, wherein each lighting tube is made of glass material or plastic material.

20. The omnidirectional LED lamp as claimed in claim 15, wherein a light-diffusing material is coated on the inner wall or an outer wall of each lighting tube.

* * * * *